US009881748B2

(12) United States Patent
Hsiao

(10) Patent No.: US 9,881,748 B2
(45) Date of Patent: Jan. 30, 2018

(54) KEY STRUCTURE AND KEYBOARD USING THE SAME

(71) Applicant: ASUSTeK COMPUTER INC., Taipei (TW)

(72) Inventor: Li-Sheng Hsiao, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 15/345,519

(22) Filed: Nov. 8, 2016

(65) Prior Publication Data

US 2017/0148584 A1 May 25, 2017

Related U.S. Application Data

(60) Provisional application No. 62/257,235, filed on Nov. 19, 2015.

(30) Foreign Application Priority Data

Sep. 26, 2016 (CN) ..... 2016 1 0848414

(51) Int. Cl.
*H01H 13/70* (2006.01)
*H01H 3/46* (2006.01)
*H01H 3/12* (2006.01)

(52) U.S. Cl.
CPC ..... *H01H 3/46* (2013.01); *H01H 3/12* (2013.01)

(58) Field of Classification Search
CPC .. H01H 3/00; H01H 3/02; H01H 3/12; H01H 3/32; H01H 5/00; H01H 5/04; H01H 5/06; H01H 5/18; H01H 5/20; H01H 9/20; H01H 9/24; H01H 13/00; H01H 13/20; H01H 13/22; H01H 13/26; H01H 13/36; H01H 13/50; H01H 13/52; H01H 13/70; H01H 13/7006; H01H 2003/00; H01H 2003/02; H01H 2003/12; H01H 2009/20; H01H 2205/014; H01H 2237/00; H01H 2237/004; H01H 2237/008; H01H 3/46; H01H 9/00
(Continued)

(56) References Cited

U.S. PATENT DOCUMENTS 6,137,071 A * 10/2000 Yeh ..... H01H 3/125 200/341
8,957,337 B2 * 2/2015 Niu ..... H01H 3/125 200/344

FOREIGN PATENT DOCUMENTS

CN 2468147 Y 12/2001
CN 2480895 Y 3/2002
(Continued)

*Primary Examiner* — Anthony R. Jimenez
(74) *Attorney, Agent, or Firm* — CKC & Partners Co., Ltd.

(57) ABSTRACT

A key structure includes a base, a keycap, and a connecting rod. The base includes a structural plate and a connecting plate. The connecting plate is configured on the structural plate. The keycap is configured on the structural plate and includes a plate body and a first hook. The connecting rod is configured under the structural plate and extending towards an extension direction. The connecting rod includes at least a second hook. The connecting rod moves along the extension direction relative to the base to drive the second hook to be fastened to or detached from the first hook. When the first hook is detached from the second hook, the keycap moves relative to the connecting rod to expose the space between the keycap and the base, and then the key structure is easily repaired or cleaned.

8 Claims, 5 Drawing Sheets

(58) Field of Classification Search
USPC ..... 200/310, 5 A, 5 R, 511–512, 520, 521,
200/308, 311, 313, 314, 317, 337, 341,
200/343, 345, 292, 329
See application file for complete search history.

(56) References Cited

FOREIGN PATENT DOCUMENTS

| | | | |
|---|---|---|---|
| CN | 202616105 | U | 12/2012 |
| CN | 204257938 | U | 4/2015 |
| CN | 204704548 | U | 10/2015 |
| TW | 315959 | U | 9/1997 |

* cited by examiner

KEY STRUCTURE AND KEYBOARD USING THE SAME

CROSS-REFERENCE TO RELATED APPLICATION

This application claims the priority benefit of U.S. provisional application Ser. No. 62/257,235, filed on Nov. 19, 2015 and CN application No. 201610848414.9, filed on Sep. 26, 2016. The entirety of the above-mentioned patent applications are hereby incorporated by references herein and made a part of specification.

BACKGROUND OF THE INVENTION

Field of the Invention

The disclosure relates to a key structure and, more particularly, relates to a key structure for a keyboard.

Description of the Related Art

With science and technology advancement, the computer becomes necessary in daily life. Varies data are input to the computer and processed by the computer via varies input tools, such as a keyboard.

BRIEF SUMMARY OF THE INVENTION

A key structure including a base, a keycap, and a connecting rod is provided. The base includes a structural plate and a connecting plate. The connecting plate is configured on the structural plate. The keycap is configured on the structural plate and includes a plate body and a first hook. The connecting rod is configured under the structural plate and extends towards an extension direction. The connecting rod at least includes a second hook. The connecting rod is configured to move along the extension direction relative to the base, to drive the second hook to be fastened to or detached from the first book.

By pushing the connecting rod to move along the extension direction relative to the base, the first hook of the keycap is easily fastened to or detached from the second hook of the connecting rod. When the first hook is fastened to the second hook, the keycap is fixed to the connecting rod. When the first hook is detached from the second hook, the keycap moves relative to the connecting rod to expose the space between the keycap and the base, which allows the key structure is easily repaired or cleaned. The service life of the key structure is thus prolonged. The first hook is easily fastened to or detached from the second hook without any additional tools, which is rather convenient.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Figure 1:
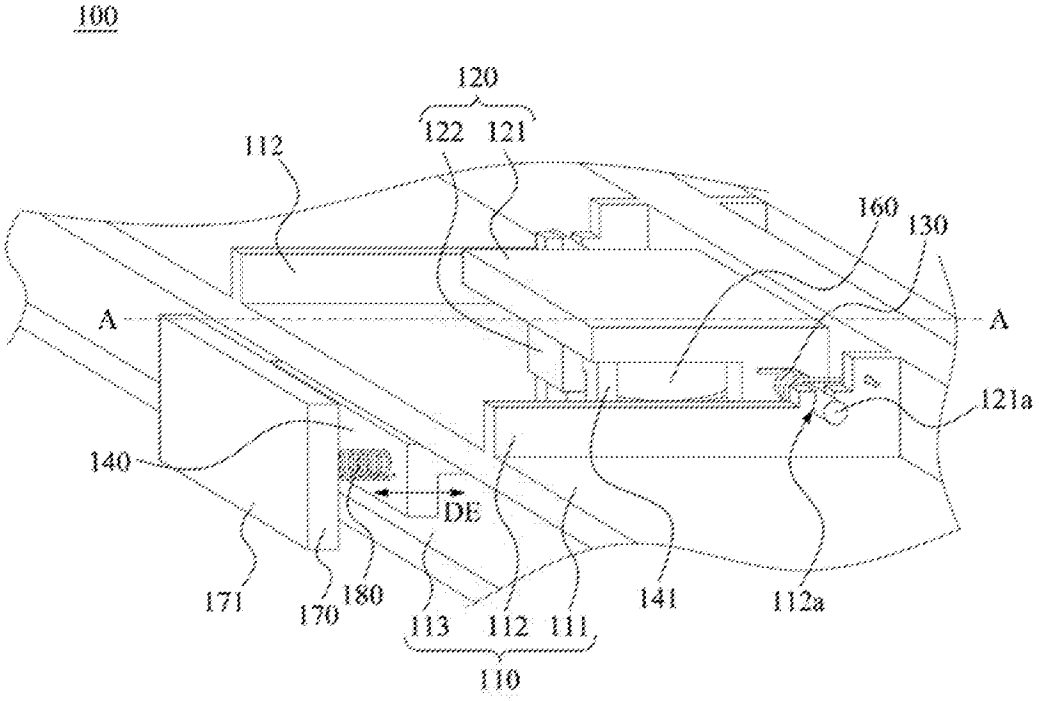
FIG. 1 is a schematic diagram showing a key structure in an embodiment.
Figure 2:
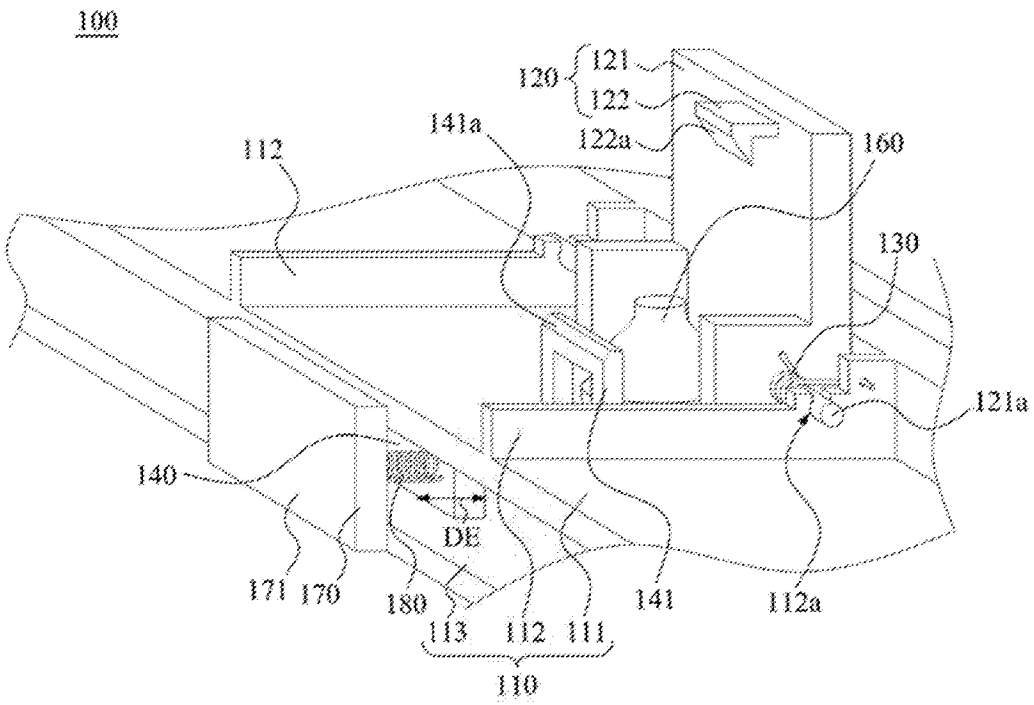
FIG. 2 is a schematic diagram showing a key structure of which the connecting rod is pushed and the second hook is detached from the first book in an embodiment.

As shown in FIG. 1 and FIG. 2, FIG. 1 is a schematic diagram showing a key structure in an embodiment, FIG. 2 is a schematic diagram showing a key structure of which the connecting rod 140 is pushed and the second hook 141 is detached from the first hook 122 in an embodiment. As shown in FIG. 1 and FIG. 2, a key structure 100 includes a base 110, a keycap 120, and a connecting rod 140. The base 110 includes a structural plate 111 and at least a connecting plate 112. The connecting plate 112 is configured on the structural plate 111. The keycap 120 is configured on the structural plate 111. The keycap 120 includes a plate body 121 and a first hook 122. The connecting rod 140 is configured under the structural plate 111, and the connecting rod 140 extends towards the extension direction DE. The connecting rod 140 at least includes a second hook 141. The connecting rod 140 is configured to move along the extension direction DE relative to the base 110. The second hook 141 is then fastened to or detached from the first hook 122.

As the connecting rod 140 moves along the extension direction DE relates to the base 110, the first hook 122 of the keycap 120 is fastened to or detached from the second hook 141 of the connecting rod 140. When the first hook 122 is fastened to the second hook 141, the keycap 120 is fixed to the connecting rod 140. When the first hook 122 is detached from the second hook 141, the keycap 120 moves relative to the connecting rod 140 to expose the space between the keycap 120 and the base 110. Then, the key structure 100 is cleaned or repaired easily and the service life of the key structure 100 is increased. Moreover, the first hook 122 is easily fastened to or detached from the second hook 141, which is tool free and simply.

The connecting plate 112 of the base 110 includes a first pivotal portion 112*a*. The plate body 121 of the keycap 120 includes a second pivotal portion 121*a*. The second pivotal portion 121*a* is configured corresponding to the first hook 122 and pivotally connected to the first pivotal portion 112*a*. As a result, the second pivotal portion 121*a* is pivotally connected to the first pivotal portion 112*a*. When the first hook 122 is detached from the second hook 141, the keycap 120 rotates relative to the connecting plate 112 of the base 110. The space between the keycap 120 and the base 110 is exposed to facilitate cleaning and repairing the key structure 100.

As shown in FIG. 1, the key structure 100 includes a first elastic unit 130. The first elastic unit 130 is connected to the connecting plate 112 and the plate body 121. When the key structure 100 is in a using state, the second hook 141 of the connecting rod 140 is fastened to the first hook 122 of the keycap 120. The first elastic unit 130 is then compressed to store the elastic energy. In an embodiment, the first elastic unit 130 is a torsional spring, which is not limited herein. When the key structure 100 is in the using state, the keycap 120 is pressed towards the structural plate 111 of the base 110. And the electronic device (not shown) connects to the key structure 100 and receives an input signal.

Figure 3A:
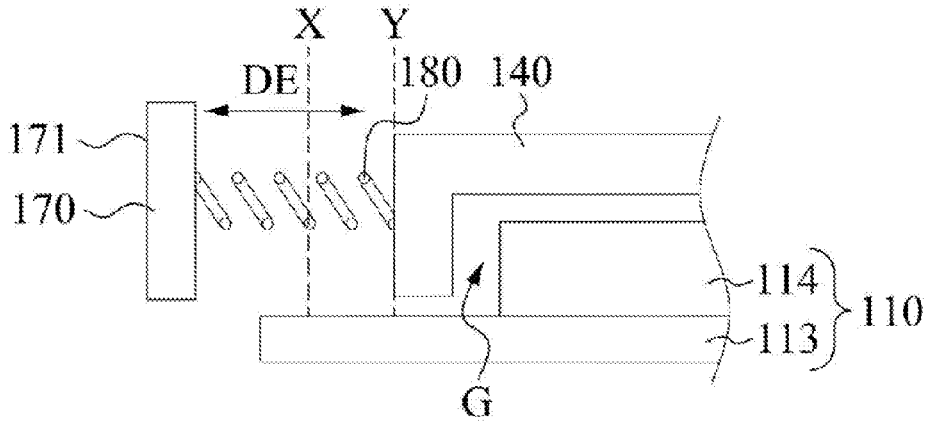
FIG. 3A and FIG. 3B are schematic diagrams showing the movement of the second elastic unit in an embodiment.
Figure 3B:
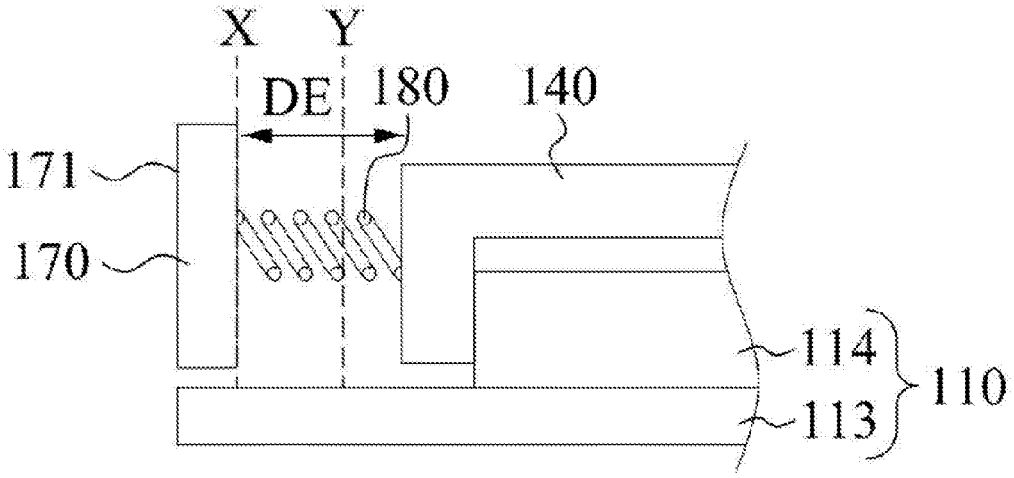

As shown in FIG. 1 and FIG. 2, the key structure 100 further includes a second elastic unit 180. The second elastic unit 180 is connected to a side portion of the connecting rod 140 away from the second hook 141 along the extension direction DE. As shown in FIG. 1 and FIG. 3A and FIG. 3B, the movement of the second elastic unit 180 is revealed. The base 110 further includes an abutment part 114. The abutment part 114 locates at a side portion of the casing 113 facing to the connecting rod 140. As shown in FIG. 3A, before the second elastic unit 180 is pressed, the connecting rod 140 locates at a position Y and a space G locates between the connecting rod 140 and the abutment part 114 of the base 110. As shown in FIG. 3B, after the second elastic unit 180 is pressed, the connecting rod 140 moves from the position Y towards the abutment part 114 of the base 110 until the connecting rod 140 contacts the abutment part 114 and the space G disappears. At the time, the end of the second elastic unit 180 away from the connecting rod 140 reaches to the position X, and the second elastic unit 180 is in a compressed state and stores the elastic energy. When the user does not press the second elastic unit 180, the second elastic unit 180 releases the elastic energy, which makes the connecting rod 140 apply a force on the abutment part 114 of the base 110. The abutment part 114 has a counter force onto the connecting rod 140 to push the connecting rod 140 to move away from the abutment part 114. Then, the space G exists between the connecting rod 140 and the abutment part 114. The connecting rod 140 moves back to the position Y. The second elastic unit 180 restores to the original position. The end of the second elastic unit 180 away from the connecting rod 140 leaves the position X. That is, the second elastic unit 180 restores to the state as shown in FIG. 3A.

With the buffer of the second elastic unit 180, the connecting rod 140 is not easily damaged. In an embodiment, the third elastic unit 180 includes at least one compression spring, which is not limited herein.

In an embodiment, the key structure 100 further includes a button 170. As shown in FIG. 1, FIG. 2, FIG. 3A, and FIG. 3B, the button 170 is configured at an end away from the connecting rod 140. The button 170 includes a press surface 171. The press surface 171 locates a surface of the button 170 away from the second hook 141. Thus, to press the connecting rod 140, the press surface 171 of the button 170 is pressed. The button 170 along with the connecting rod 140 moves along the extension direction DE.

In an embodiment, the key structure 100 further includes a buffer module 160. As shown in FIG. 1 and FIG. 2, the buffer module 160 is configured on the structural plate 111 of the base 110. The buffer module 160 is configured to abut against the plate body 121 of the keycap 120. When the keycap 120 is pressed towards the structural plate 111 of the base 110. The buffer module 160 is pressed and stores the elastic energy. When the keycap 120 is not pressed, the buffer module 160 releases the stored elastic energy to reposition the keycap 120. In an embodiment, the buffer module 160 is made of rubber.

As shown in FIG. 2, to clean or repair the key structure 100, the button 170 is pressed to push the connecting rod 140 to move along the extension direction DE. The second hook 141 of the connecting rod 140 is detached from the first hook 122 of the keycap 120. That is, the second hook 141 is not fastened to the first hook 122. The first elastic unit 130 restores to the original position and releases the elastic energy. Then, the keycap 120 rotates around the second pivotal portion 121*a* relative to the base 110. The first hook 122 of the keycap 120 moves away from the second hook 141 of the connecting rod 140. As a result, the space between the keycap 120 and the base 110 is exposed to facilitate cleaning or repairing the key structure 100. The way of exposing the space between the keycap 120 and the base 110 is easy.

After the cleaning and the repairing, the key structure 100 restores to the using state. That is, to make the second hook 141 of the connecting rod 140 fasten to the first hook 122 of the keycap 120. The surface of the plate body 121 of the keycap 120 which away from the structural plate 111 is pressed, the keycap 120 rotates around the second pivotal portion 121*a* relative to the base 110. The first hook 122 of the keycap 120 moves towards the second hook 141 of the connecting rod 140 until the first hook 122 is fastened to the second hook 141, and then the key structure 100 restores to the using state. The process of restoring the key structure 100 to the using state is simple and easy, which is convenient for users.

In an embodiment, the first hook 122 includes an inclined surface 122*a*. The second hook 141 includes an inclined surface 141*a*. The inclined surface 141*a* is configured corresponding to the inclined surface 122*a*. When the key structure 100 restores to the using state, the first hook 122 of the keycap 120 moves toward the second hook 141 of the connecting rod 140. The inclined surface 122*a* of the first hook 122 abuts against the inclined surface 141*a* of the second hook 141, and the rubs against the inclined surface 141*a* of the second hook 141 to make the first hook 122 and/or the second hook 141 deformed until the first hook 122 is fastened to the second hook 141.

As shown in FIG. 1, FIG. 2, FIG. 3A, and FIG. 3B, the base 110 further includes a casing 113. The casing 113 is configured corresponding to the structural plate 111. At least part of the connecting rod 140 locates between the casing 113 and the structural plate 111. That is, the connecting rod 140 moves between the casing 113 and the structural plate 111 along the extension direction DE.

As shown in FIG. 1 and FIG. 2, in an embodiment, the number of the connecting plate 112 is two. At least part of the keycap 120 locates between the connecting plates 112. The keycap 120 is pivotally connected to the connecting plate 112. Consequently, the keycap 120 is configured corresponding to the base 110 for more stable condition.

Figure 4:
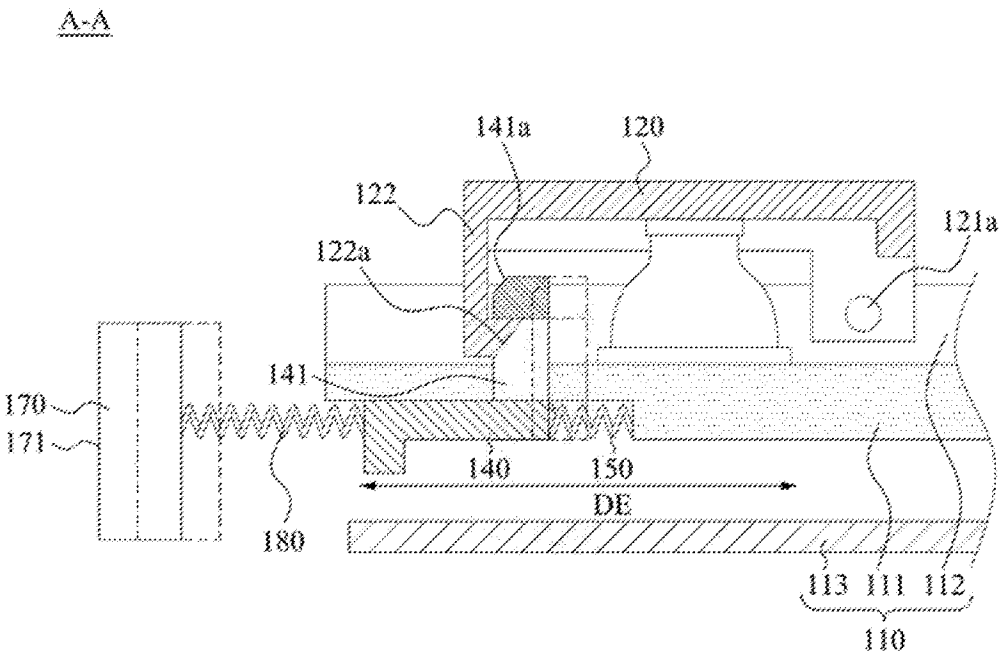
FIG. 4 is a schematic diagram showing a key structure viewed from a section along a line A in FIG. 1 in an embodiment.

FIG. 4 is a schematic diagram showing a key structure in FIG. 1 from a section along a line A in an embodiment. As shown in FIG. 4, the key structure 100 further includes a third elastic unit 150. The third elastic unit 150 is connected to the connecting rod 140 and the base 110 along the extension direction DE. To repair or clean the key structure 100, the connecting rod 140 is pressed. Then the connecting rod 140 moves along the extension direction DE. The second hook 141 of the connecting rod 140 is detached from the first hook 122 of the keycap 120. In the embodiment, the third elastic unit 150 is connected to the connecting rod 140 and the base 110 along the extension direction DE. When the connecting rod 140 moves along the extension direction DE and makes the second hook 141 of the connecting rod 140 detached from the first hook 122 of the keycap 120, the third elastic unit 150 would be pressed and stored the elastic energy. When the connecting rod 140 is not pressed, the elastic energy of the third elastic unit 150 releases and the connecting rod 140 restores to the original position. In an embodiment, the third elastic trait 150 is a compress spring.

Figure 5:
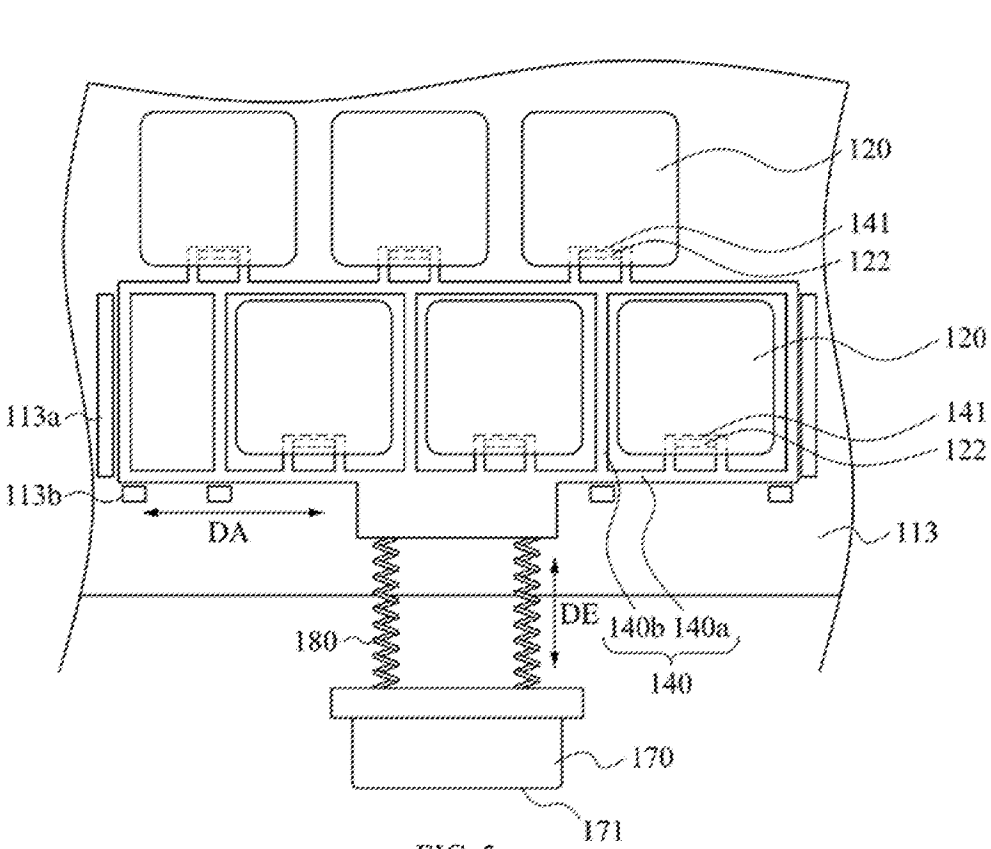
FIG. 5 is a top view of a key structure without showing the structural plate of the base in an embodiment.

FIG. 5 is a top view of a key structure 100 without showing the structural plate of the base in an embodiment. In the embodiment, as shown in FIG. 5, the connecting rod 140 includes a plurality of second hooks 141. The key structure 100 includes a plurality of the keycaps 120. The connecting rod 140 further includes the first sub connecting rods 140*a* and the second sub connecting rods 140*b*. The first sub connecting rods 140*a* are configured along the arrangement direction DA. The arrangement direction DA is perpendicular to the extension direction DE. The second hooks 141 are configured at the first sub connecting rods 140*a*. The first hooks 122 are configured corresponding to the second hooks 141, respectively. The second sub connecting rods 140*b* are configured along the extension direction DE and connected between the first sub connecting rods 140*a*, respectively. As a result, by pushing the connecting rod 140, the second hooks 141*s* at the first sub connecting rods 140*a* are detached from the first hooks 122 of the keycap 120, respectively. Consequently, by pushing one connecting rod 140, the spaces between the keycaps 120 and the base 110 are exposed for cleaning or repairing, which is convenient and efficient.

As shown in FIG. 5, the casing 113 further includes a barricade 113*a* and a protrusion 113*b* facing the structural plate 111 (as shown in FIG. 1, FIG. 2 and FIG. 4). In the embodiment, the barricade 113*a* is configured at an outer side portion of the connecting rod 140 along the arrangement direction DA to stop the movement of the connecting rod 140 along the arrangement direction DA. The protrusion 113*b* is configured at an end of the connecting rod 140 facing to the button 170 to stop the connecting rod 140 moving towards the button 170 along the extension direction DE. As a result, with the barricade 113*a* and the protrusion 113*b*, the movement of the connecting rod 140 relative to the base 110 along the arrangement direction DA and the extension direction DE is restricted.

In sum, by moving the connecting rod along the extension direction relative to the base, the first book of the keycap is easily fastened to or detached from the second hook of the connecting rod. When the first hook is fastened to the second hook, the relative position between the keycap and the connecting rod is fixed. When the first hook is detached from the second hook, the keycap moves relative to the connecting rod to expose the space between the keycap and the base. As a result, the key structure can be cleaned or repaired easily, and the service life of the key structure can be prolonged. Additionally, the first hook is easily fastened to or detached from the second hook without any additional tools, which is convenient.

Since the second pivotal portion is pivotally connected to the first pivotal portion, when the first hook is detached from the second hook, the keycap is rotated relative to the connecting plate of the base. Consequently, the space between the keycap and the base is exposed to facilitate cleaning and repairing.

To restore the key structure to the using state, that is, to make the second hook of the connecting rod fastened to the first hook of the keycap, a side surface the plate body of the keycap which away from the structural plate is pressed to make the keycap rotate around the base relative to the second pivotal portion. The first hook of the keycap moves towards the second hook of the connecting rod until the first hook is fastened to the second hook. Then, the key structure restores to the using state. As a result, the process that the key structure restores to the using state is simple and no additional tool is needed, which is convenient.

By pushing the connecting rod, the second hooks configured at the first sub connecting rod are detached from the first hooks of the keycap. Consequently, the space between the keycaps and the base is exposed by pushing the connecting rod for cleaning or repairing the key structure, which is convenient and efficient.

Although the disclosure has been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. A key structure, comprising:

a base including a structural plate and a connecting plate, wherein the connecting plate is configured on the structural plate;

a keycap configured on the structural plate and including a plate body and a first hook;

a connecting rod configured under the structural plate and extending towards an extension direction, wherein the connecting rod at least includes a second hook;

a second elastic unit connected to a side portion of the connection rod away from the second hook along the extension direction; and wherein the connecting rod is configured to move along the extension direction relative to the base, to drive the second hook to be fastened to or detached from the first hook.

2. The key structure according to claim 1, wherein the connecting plate includes a first pivotal portion, the plate body includes a second pivotal portion, the second pivotal portion is configured corresponding to the first hook and pivotally connected to the first pivotal portion.

3. The key structure according to claim 1, further comprising a first elastic unit connected to the connecting plate and the plate body.

4. The key structure according to claim 1, wherein the key structure further includes a button and the second elastic unit is connected between the button and the connecting rod.

5. The key structure according to claim 1, further comprising a buffer module configured on the structural plate and configured to abut against the plate body.

6. The key structure according to claim 1, wherein the base further comprises a casing configured corresponding to the structural plate, and at least part of the connecting rod locates between the casing and the structural plate.

7. The key structure according to claim 1, further comprising a third elastic unit connected to the connecting rod and the base.

8. The key structure according to claim 1, wherein the connecting rod includes a plurality of the second hooks, the key structure includes a plurality of the keycaps, and the connecting rod further comprises:

a plurality of a first sub connecting rods configured along an arrangement direction, wherein the arrangement direction is perpendicular to the extension direction, the second hooks are configured at the first sub connecting rods, respectively, and the first hook is configured corresponding to the second hook; and a plurality of a second sub connecting rods are configured along the extension direction and connected between the first sub connecting rods.

* * * * *